US009022886B2

(12) United States Patent
Faller

(10) Patent No.: US 9,022,886 B2
(45) Date of Patent: May 5, 2015

(54) HUNTING ARROW TIP AND METHOD OF MANUFACTURE

(71) Applicant: Zack Faller, Marysville, WA (US)

(72) Inventor: Zack Faller, Marysville, WA (US)

( * ) Notice: Subject to any disclaimer, the term of this patent is extended or adjusted under 35 U.S.C. 154(b) by 0 days.

(21) Appl. No.: 14/065,508

(22) Filed: Oct. 29, 2013

(65) Prior Publication Data

US 2014/0128184 A1 May 8, 2014

Related U.S. Application Data

(60) Provisional application No. 61/720,476, filed on Oct. 31, 2012.

(51) Int. Cl.
*F42B 6/08* (2006.01)

(52) U.S. Cl.
CPC ..... *F42B 6/08* (2013.01)

(58) Field of Classification Search
USPC ..... 473/582, 583
See application file for complete search history.

(56) References Cited

U.S. PATENT DOCUMENTS

| | | | | |
|---|---|---|---|---|
| 2,937,873 | A * | 5/1960 | Grissinger | 473/582 |
| 3,241,836 | A * | 3/1966 | Zwickey | 473/582 |
| 4,396,196 | A | 8/1983 | Drennan | |
| 5,078,407 | A | 1/1992 | Carlston et al. | |
| 6,311,623 | B1 | 11/2001 | Zaruba | |
| 7,232,389 | B2 | 6/2007 | Monteleone | |
| 7,314,419 | B2 * | 1/2008 | Grace et al. | 473/583 |
| 8,105,188 | B1 * | 1/2012 | Mercer | 473/583 |
| 8,678,960 | B2 * | 3/2014 | Bierfreund | 473/583 |

* cited by examiner

*Primary Examiner* — John Ricci
(74) *Attorney, Agent, or Firm* — Steven Fisher-Stawinski; Robert W. Gray; The Gray Law Group, Ltd

(57) ABSTRACT

A tip for a hunting arrow and a method of manufacturing the same are disclosed. A bullet-shaped tip is affixed to a shaft region and a threaded shaft for attachment to the threaded engagement of a standard hunting arrow. A pair of barbs extends out and forward from the tip. The barbs may be manufactured by creating a hole in a standard arrow tip transverse to the axial line thereof, and forcing a length of wire through the hole. The wire may be retained with a glue or sealant, and may be bent forward to a desired shape and sharpened.

3 Claims, 2 Drawing Sheets

HUNTING ARROW TIP AND METHOD OF MANUFACTURE

CROSS-REFERENCE TO RELATED APPLICATIONS

This application claims priority to U.S. Provisional Application No. 61/720,476 filed Oct. 31, 2012, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

The invention relates generally to arrow tips, and in particular to arrow tips having improved characteristics for hunting small game. Conventional single-tip hunting arrows provide a single point into which the force of entry is concentrated. For large game, this enables maximum penetration and the greatest likelihood of a kill. For small game, however, the arrow can pass through completely leaving a mangled carcass that is unsuitable for eating or taxidermy. A preferable arrow tip would allow the intended damage to be reduced or adjusted for smaller game animals.

SUMMARY OF THE INVENTION

Accordingly, the invention is directed to an improved tip for a hunting arrow and to a method of manufacturing the same. A bullet-shaped tip is affixed to a shaft region and a threaded bore for attachment to the threaded engagement of a standard hunting arrow. A pair of barbs extends out and forward from the tip. The barbs may be manufactured by creating a hole in a standard arrow tip transverse to the axial line thereof, and forcing a length of wire through the hole. The wire may be retained with a glue or sealant, and may be bent forward to a desired shape and sharpened.

It is an object of the invention to provide an arrow tip having superior characteristics for hunting small game.

It is an object of the invention to provide an arrow tip having barbs, the shape thereof being determinative of the desired amount of damage inflicted upon prey.

It is an object of the invention to provide an arrow tip having reduced flight noise.

It is an object of the invention to provide an arrow tip that tends to catch in foliage or grass and not embed deeply in earth or wood, allowing for easy retrieval.

It is an object of the invention to provide an arrow tip having improved features but unchanged flight characteristics compared to a standard arrow tip.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawing is included to provide a further understanding of the invention and is incorporated into and constitutes a part of the specification. It illustrates one embodiment of the invention and, together with the description, serves to explain the principles of the invention.

DETAILED DESCRIPTION OF THE INVENTION

Figure 1:
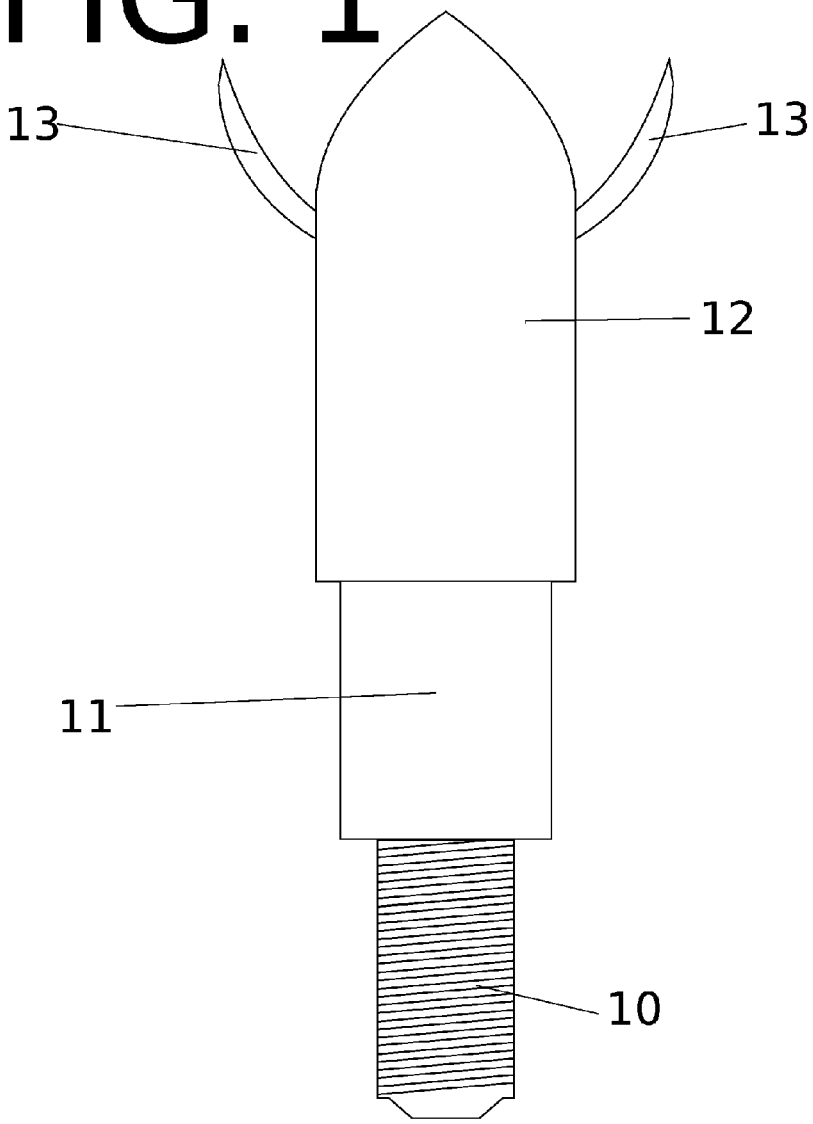
FIG. 1 shows a side view of the first exemplary embodiment, displaying the threaded bore 10, shaft region 11, tip 12, and barbs 13.

Referring now to the invention in more detail, the invention is directed to an improved tip for a hunting arrow. FIG. 1 shows the first exemplary embodiment. In the first exemplary embodiment, a threaded bore 10 is affixed to the first end of a shaft region 11. The threaded bore 10 is of an appropriate diameter and thread density for engagement to a hunting arrow having an engagement bracket for a threaded tip attachment, such as a standard hunting arrow. The shaft region 11 may be of an appropriate length and diameter to engage with an unthreaded fore-region, which may be provided within the arrow's engagement bracket. The second end of the shaft region 11 is fixed to the first end of a tip 12, which terminates in a bullet-shaped point.

Affixed to the sides of tip 12 or shaft region 11 and spaced about 180° relative to one another are a pair of barbs 13, which are bent outward and forward from the tip 12 and sharpened with the profile of a cylinder sheared at a steep angle. The barbs 13 may be of a variable length and angle, with longer lengths and wider angle corresponding to more damage inflicted on prey. For example, longer barbs 13 having a wider approach are preferable for larger small game such as turkeys, while shorter barbs 13 with a narrower approach may be preferable for smaller small game such as rabbits. The apparatus may be constructed of steel or other metal or non-metal material. The components may be joined with adhesives, welding, or other fastener, or may be constructed monolithically from one piece of material. In particular, the components other than the barbs 13 may be constructed monolithically and be joined to a single wire piece to form the barbs 13 according to the method below.

The arrow tip of the first exemplary embodiment may be manufactured by starting with a conventional threaded tip for a standard hunting arrow and drilling a hole that is transverse to axis through the tip 12 near the point. A wire is then pressed through the hole. The diameter of the hole and the gauge of the wire are selected based on a tight fit with the wire slightly wider than the hole. Machine tools may enable a larger gauge of wire to be forced through the hole than may be accomplished by hand or pith hand tools. The wire is then bent forward until it reaches forward to about the same degree or slightly less than the tip. With the wire in the desired position to form the barbs 13, a glue or sealant may be applied to the hole/joint region to keep the barbs 13 in place. The barb tips may then be sheared off and sharpened, for example on a grindstone or belt sander.

Figure 2:
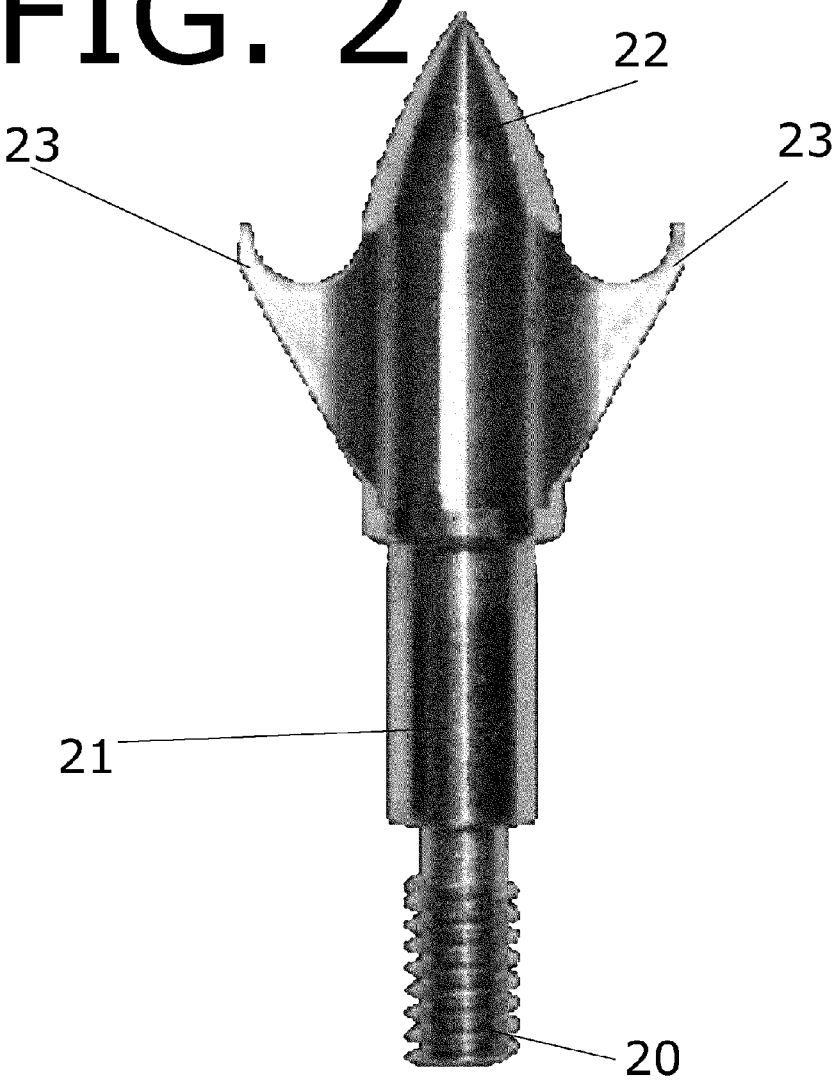
FIG. 2 shows a side view of the second exemplary embodiment, displaying the threaded bore 20, shaft region 21, tip 22, and barbs 13.

Referring now to the second exemplary embodiment of FIG. 2, the second exemplary embodiment comprises a threaded bore 20, shaft region 21, tip 22, and barbs 23, each essentially corresponding to those of the first exemplary embodiment. However the second exemplary embodiment is preferably manufactured not by threading a wire to create the barbs 23, but by machining or casting the entire arrowhead as a single piece wherein the barbs 23 are presented as shown having a rectangular cross section rather than a circular cross section, and likewise having a filled-in structure between the barbs 23 and the shaft region 21.

In experiments, the arrow tip of the invention was found to provide superior damage to small game than conventional hunting arrows, with longer barbs having a wider approach tending to cause more damage than shorter barbs with a narrower approach. The arrow of the invention was found the have flight characteristics that were essentially the same as those of an arrow fitted with a conventional tip. The arrow of the invention was further observed to produce reduced flight noise as compared to an arrow fitted with a conventional tip. And the arrow of the invention was observed to tend to catch in grass and foliage, rather than deep into soil or wood, thereby allowing for relatively easy retrieval.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. An arrowhead for hunting purposes comprising:

(a) a bullet-shaped or conical tip;

(b) a shaft region located immediately behind the tip;

(c) a threaded shaft suitable for attachment to the threaded engagement of a standard hunting arrow, said threaded shaft being located immediately behind said shaft region;

(d) a plurality of barbs, said plurality of barbs being angled forward from one of said shaft region or the sloped sides of said bullet-shaped or conical tip;

(e) said plurality of barbs being two in number and diametrically opposed about the axial line of said tip; and (f) each said plurality of barbs having a rectangular cross;

whereby a user may engage in the bow hunting of small game by affixing said arrowhead to a standard hunting arrow.

2. The arrowhead of claim 1 wherein said plurality of barbs are of a relatively long length and relatively small angle whereby said arrowhead is configured for optimal damage to relatively large small game animals.

3. The arrowhead of claim 1 wherein said plurality of barbs are of a relatively short length and relatively large angle whereby said arrowhead is configured for optimal damage to relatively small small game animals.

* * * * *